United States Patent [19]

Yoshida et al.

[11] 4,316,780

[45] Feb. 23, 1982

[54] METHOD OF PRODUCING COLOR-ANODIZED ALUMINIUM ARTICLES

[75] Inventors: Kohichi Yoshida, Shimizu; Teruo Miyashita, Fuji; Hiroshi Sano, Shimizu, all of Japan

[73] Assignee: Nippon Light Metal Company Limited, Tokyo, Japan

[21] Appl. No.: 188,260

[22] Filed: Sep. 17, 1980

[30] Foreign Application Priority Data

Sep. 20, 1979 [JP] Japan ..... 54-120151

[51] Int. Cl.[3] ..... C25D 11/12; C25D 11/22

[52] U.S. Cl. ..... 204/35 N; 204/42; 204/58; 204/DIG. 9; 204/38 A; 204/181 R

[58] Field of Search ..... 204/58, 35 N, DIG. 9, 204/42, 38 A, 181

[56] References Cited

U.S. PATENT DOCUMENTS

| | | | |
|---|---|---|---|
| 3,761,362 | 9/1973 | Oida et al. | 204/58 |
| 3,791,943 | 2/1974 | Mita et al. | 204/58 |
| 3,878,056 | 4/1975 | Yanagida et al. | 204/35 N |
| 3,915,813 | 10/1975 | Abe et al. | 204/35 N |
| 3,935,084 | 1/1976 | Terai et al. | 204/58 |
| 4,014,758 | 3/1977 | Kawai et al. | 204/35 N |
| 4,021,315 | 5/1977 | Yanagida et al. | 204/58 |
| 4,128,460 | 12/1978 | Nishimura et al. | 204/35 N |
| 4,226,680 | 10/1980 | Cooke et al. | 204/35 N |

FOREIGN PATENT DOCUMENTS

| | | | |
|---|---|---|---|
| 42-19842 | 7/1967 | Japan | 204/58 |

*Primary Examiner*—R. L. Andrews

*Attorney, Agent, or Firm*—William J. Daniel

[57] ABSTRACT

Disclosed is a method of coloring an anodized and anodically reinforced aluminum or aluminum alloy article by cathodic treatment in a coloring solution wherein the cathodic electrolytic current is a negative voltage direct current having a duration substantially less than the interval therebetween and being repeated at a frequency sufficient to produce the required coloration.

14 Claims, 4 Drawing Figures

METHOD OF PRODUCING COLOR-ANODIZED ALUMINIUM ARTICLES

Figure 1A:
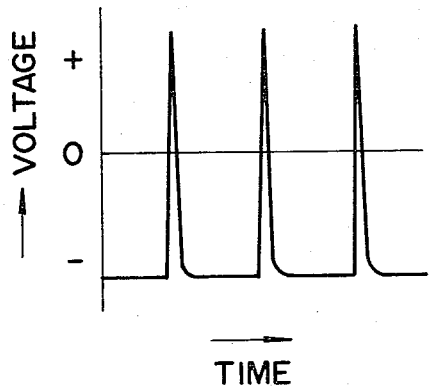

The present invention relates to a method of producing colour-anodized aluminium or aluminium alloy articles.

Recently, aluminium articles coated with coloured anodic oxide film have been widely utilized in buildings, vehicles, household appliances etc. The surface of these aluminium articles can be coloured by coating with a porous anodic oxide film followed by dyeing in a well known manner. However, pigmentation with dyes has poor resistance to weather and readily becomes discoloured when exposed to sunshine, wind and/or rain. Therefore, several improvements have been proposed to produce weather resistant colours in anodic oxide films on aluminium articles. In one improved method, an aluminium article previously coated with anodic oxide film is used as one electrode and electrolyzed with alternating current in an electrolytic bath containing a soluble metal salt or soluble metal salts, e.g. nickel, cobalt, copper, tin etc. In another method, the article is used as a cathods and electrolyzed by direct current, thus the electrolytic product deposits in the film to generate the desired colour depending on the kind of a metal salt or metal salts contained in the bath.

In the first improved method (i.e. AC electrolytic colouring of the film using electrolyte of the above-mentioned metal salt solution) colouring of the film is carried out under relatively stable conditions without destroying the anodic oxide film on the aluminium surface. However this is a lengthy process and was, therefore, not always suitable for an industrial colouring treatment of the aluminium articles in mass production. In the latter method, (i.e. DC electrolytic colouring with aluminium articles as a cathode) colouring of the film can be completed in a relatively short time. However, the film is often destroyed during electrolytic colouring. In some cases, so-called "spalling" occurs, i.e. there is a localised break-down of the film itself during electrolytic colouring. In particular, this undesirable tendency is often increased depending on the kind of ions contained as impurities in the bath (e.g. alkali metal ions). To reduce these drawbacks, it has been proposed in this second kind of process initially to treat the aluminium article coated with anodic oxide film while acting as an anode, in advance of the electrolytic colouring step and to subject the article to preliminary electrolytic treatment with anodic direct current, to reinforce the barrier layer of the anodic oxide film, in the electrolytic bath containing the same metal salt or salts. The aluminium article is then used as a cathode for electrolytic colouring. This avoids film destruction by spalling during the DC electrolytic colouring in the bath containing a metal salt or metal salts.

Research work on the electrolytic colouring for aluminium articles, utilizing electrolytic baths containing a metal salt or metal salts, has demonstrated that when preliminary electrolytic treatment with anodic DC current is applied to the aluminium articles with anodic oxide film in an electrolytic bath containing a metal salt or metal salts, it not only prevents spalling which causes film breaking during electrolytic colouring but also drastically improves the throwing power of the colouring action. On the other hand, it was found that the preliminary electrolytic treatment greatly reduces the rate of colouring of the aluminium during electrolytic colouring. This is because a so-called barrier layer of aluminium oxide exists between the aluminium substrate and the porous oxide film. If DC electrolytic treatment is applied to the aluminium article anode coated with anodic oxide film by a preliminary treatment before the actual electrolytic colouring in an electrolytic bath containing a metal salt or metal salts, the barrier layer increases in thickness making the film uniform and reinforced, thus improves throwing power in the subsequent electrolytic colouring stage. The occurrence of the spalling phenomenon is also presented. However, the increase in the thickness of the barrier layer corresponding to the current density and time of the preliminary treatment, inevitably results in an increase of the electrical resistance between the aluminium article and electrolyte. Accordingly, the rate of colouring the film in the subsequent electrolytic colouring stage is much reduced giving rise to difficulty in obtaining deep coloration of the film. Therefore, in order to establish deep colouring on the film, it is preferred to make the period of preliminary electrolytic treatment as short as possible. But, if it is too short, it is not effective to prevent spalling due to deterioration of the film during electrolytic colouring. Thus the problem of overcoming the dilemma between improvement in colouring and prevention of spalling remained unsolved. In order to obtain colouring with high throwing power using conventional direct current electrolytic colouring techniques, another model was therefore proposed in which the preliminary electrolytic treatment and electrolytic colouring treatment were repeated.

One object of the present invention is to provide a solution for the above problems concerning the colouring of aluminium articles by electrolysis in a bath containing a metal salt or metal salts. According to the present invention we propose a method of producing colour-anodized aluminium or aluminium alloy articles comprising, forming an anodic oxide film on the surface of the article, subjecting the anodized article to a preliminary electrolytic treatment to reinforce the barrier layer of the anodic oxide film, and subsequently colouring the article by electrolysis in a system wherein the article works as the cathode and the electrolyte bath contains a metal salt or salts, by passing between the anode and a counter electrode of the system a direct current having superimposed thereon pulses of positive voltage. By this method, the rate of film colouring is very much increased, and even faster than the DC colouring method, not to mention the conventional AC electrolytic colouring. Furthermore, by the application of pulse voltage film deterioration usually associated with DC electrolysis is effectively suppressed. Accordingly, stable electrolytic colouring can be continued for a time sufficient to obtain effective film colouring with sufficiently deep colours and high throwing power without the risk of spalling.

Embodiments of the present invention will now be described with reference to the following examples and with reference to the accompanying drawings which show electrical wave diagrams.

As a first step an anodic oxide film is formed on the surface of the aluminium article. Preferably the article is formed from aluminium, or an aluminium alloy which has been anodized in the conventional manner using sulphuric acid, oxalic acid, sulphonic acid, chromic acid, etc. by aqueous solution in an electrolytic bath, the aluminium article being used as an anode to which an DC, AC or AC-superimposed DC current is applied.

Next, the article is subjected to preliminary electrolytic treatment by applying anodic direct current to the aluminium article coated with anodic oxide film as described above. Suitable electrolytes include aqueous solutions containing the same metal salt or salts as in the electrolytic colouring to be carried out subsequently, although it is possible to use conventional electrolytes such as dilute aqueous solutions of borax, boric acid, ammonium borate, ammonium tartarate, ammonium phosphate or citric acid, or mixture of more than one of these that can form barrier type oxide film on the surface of aluminium under direct anodic current. An anodic current density of up to 3 $A/dm^2$ is acceptable but a value of 0.5–0.5 $A/dm^2$ is preferred. The electrolysis time differs depending on the current density. If the time is too long, film resistence becomes excessively high, causing an increase in the electrical resistance of the film by growth of the barrier layer, which may give rise to difficulties in obtaining sufficiently deep colouring during the subsequent electrolytic colouring stage. Therefore, it is preferable to limit electrolysis to within 2 minutes. Normally, 20–60 seconds at a current density of 0.05–0.5 $A/dm^2$ is sufficient.

Following the above preliminary electrolytic treatment, the aluminium article is connected as a cathode in the electrolytic bath containing a metal salt or metal salts in the electrolytic colouring stage. Suitable solutions include conventional solutions of a salt or salts of nickel, cobalt, copper, tin etc. It is also preferable to keep the bath acidic with inorganic acid e.g. sulphuric acid, boric acid or organic acid, e.g. tartaric acid, citric acid etc. depending on the metal salt or salts contained in the electrolyte.

Figure 1B:
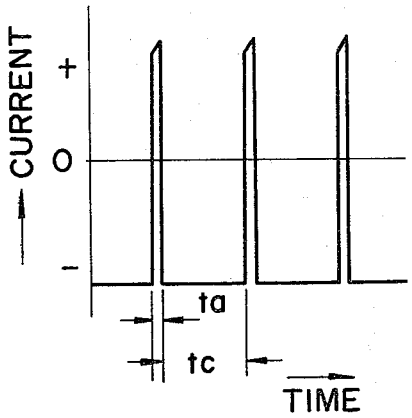

The electrolytic colouring is achieved by applying a cathodic DC current super-imposed with positive voltage pulses to the aluminium article cathods. In this case the maximum permissible value of negative current density during the cathodic period of the aluminium article is approximately 1 $A/dm^2$. However a current density in the range of 0.05–0.5 $A/dm^2$ is preferred. The FIGS. 1*a* and 1*b* exemplify the pulse voltage waveform applied to the aluminium article cathode during electrolytic colouring (FIG. 1*a*) and the current waveform applied between aluminium article and counter electrode (FIG. 1*b*). In these figures, the ordinate and abscissa relate respectively to current or voltage and time. As shown in FIGS. 1*a* and 1*b*, repeated positive voltage pulses are applied to the aluminium article, by which positive instantaneous current flows intermittently from the aluminium article to the counter electrode. In this case, pulsed voltage should be applied in such a manner that the magnitude of the positive current flowing during the anodic period is approximately the same as that of the negative current flowing during the cathodic period. Also, it is preferable for effective colouring of the film to control the cathodic current flowing between the aluminium article and the electrode, into a rectangular or similar waveform as shown in FIG. 1*b*.

With an aqueous electrolytic bath containing a metal salt or metal salts the speed of electrolytic colouring is accelerated, while spalling, due to deterioration of anodic oxide film covering aluminium article is prevented, by superimposing positive voltage pulses upon the DC electrolytic colouring current. In this case, it is preferable for the generation of stable and deep colouring on the film to control the repetition rate and time ratio ta/tc (see FIG. 1*b*) of the pulsed voltage applied to the aluminium article, where ta and tc represent respectively the conducting time of positive current during the anodic period of the aluminium article and the conducting time of negative current during the cathodic period thereof.

Furthermore, it has been found that a repetition rate of 60–1800 times/min, or more preferably, at 120–1200 times/min, excellent colouring is obtained. Experimental results show that, if the pulse repetition rate is too lo2, sufficient efficacy is not expected, whereas if excessively high, there is a tendency to decrease the colouring speed of the film.

With respect to the plus to minus time ratio ta/tc, it is generally preferred to control the ratio ta/tc within a range of 0.005–0.30 although this depends to some extent on the kind of metal salt in the electrolytic bath and the pulse repetition rate. If the ratio ta/tc is too small, the efficacy of the pulsed voltage is insufficient. On the other hand, if the ratio ta/tc is larger than 0.30, the colouring speed of film decreases causing difficulty in obtaining deep colouring due to acceleration of barrier layer growth. More preferably, the ratio should be in a range 0.01–0.25. By such selection, it becomes possible always to obtain stable, uniform and deep colouring on the film without generating spalling, by effectively combining suppression of the film deterioration during electrolytic colouring with expedition of film colouring.

Figure 2A:
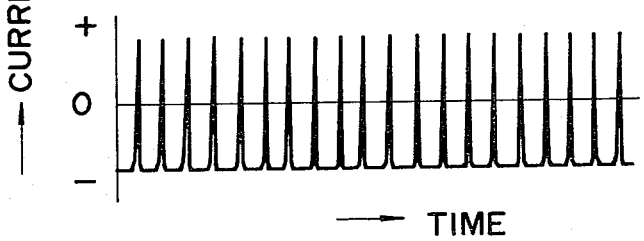
Figure 2B:
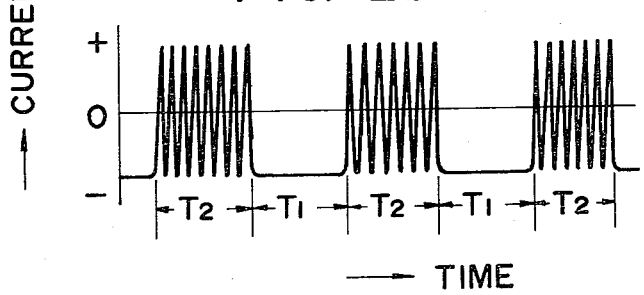

The pulsed voltage may be applied continuously throughout electrolytic colouring as shown in FIG. 2*a*. Film colouring can also be controlled, as shown in FIG. 2*b*, by applying the pulse burst voltage periodically for T2 seconds (for example, 5–20 seconds) by taking suitable intervals T1 during the electrolytic colouring process (for example 5–20 seconds).

Materials such as carbon and stainless steel which are conventionally used as a counter electrode in the electrolytic colouring of anodized aluminium can be used for a process based on the present invention. However the pulsed voltage during the colouring stage often enhances disintegration of the electrode material and may shorten its life. To avoid this disadvantage more stable metals such as Pt, Rh, Au and Ti or cheaper metals coated with one of these metals are preferred.

As the electrolysis proceeds, the anodic oxide film covering the aluminium article, is gradually pigmented in a particular colour depending upon the metal salt or salts contained in the bath.

After electrolytic colouring is complete, the aluminium article is rinsed in water and, if needed, subjected to a sealing treatment by immersion in steam or hot water and/or a finishing treatment by electrophoretic resin coating or dip coating of clear lacquer etc.

As described in the above, the aluminium article coated with an anodic oxide film is used as an anode and subjected to a preliminary electrolysis treatment in an electrolyte bath containing a metal salt or salts and is then used as a cathode while instantaneous positive voltage is repeatedly applied to the aluminium article in the form of a direct current having superimposed thereon positive voltage pulses in the electrolyte bath containing a metal salt or metal salts. The result of the application of pulse voltage is the combination of the suppression of film deterioration and acceleration of colouring. Therefore, in contrast with the conventional AC electrolytic colouring techniques using an electrolyte containing a metal salt or metal salts, deep colouring of the film can be obtained more effectively. In addition, unlike the conventional DC electrolytic colouring technique using the aluminium article simply as a cathode, there is no breakdown of the film due to spalling. Accordingly, electrolytic colouring can be carried out continuously under stable conditions, to produce an aluminium article having a deeply and uniformly coloured film.

EXAMPLE 1

A JIS A-1100 aluminium panel was anodized in a 15% sulphuric acid bath at a temperature of 20° C. by passing direct current of density 1 A/dm$^2$ to form on the surface of the panel an anodic oxide film with an average thickness of 8μ.

The aluminium panel, coated with an anodic oxide film, was then used as an anode and a titanium plate was used for the counter electrode in a nickel salt electrolyte having the following composition. Direct current was applied to the aluminium panel for 30 seconds at an anodic current density of 0.2 A/dm$^2$ for preliminary electrolytic treatment.

| Electrolyte composition | | |
|---|---|---|
| Nickel sulphate | $NiSO_4 . 6H_2O$ | 90 g/l |
| Magnesium sulphate | $MgSO_4 . 7H_2O$ | 100 g/l |
| Boric acid | $H_3BO_3$ | 40 g/l |
| Tartaric acid | | 3 g/l |
| Water | | Balance |

After this preliminary treatment, the aluminium panel was connected as a cathode and electrolytically coloured by passing a cathode direct current superimposed with anodic voltage pulses, with a titanium anode, in an electrolyte bath containing nickel salt with the same composition as in the preliminary treatment.

Electrolytic conditions during colouring were as follows:

| | |
|---|---|
| Pulse repetition rate | 600 times/min. |
| ta/tc ratio | 0.10 |
| Cathodic current density | 0.2 A/dm$^2$ |
| Time of electrolysis | 75 to 420 seconds |
| Bath temperature | 30° C. |

As the electrolysis proceeded a gradual deepening of the film colouring occurred. During electrolysis which no breaking of film occurred due to spalling.

The electrolytically coloured aluminium panel was then rinsed in water, and sealed in boiling water. Thus quite uniform colouring over range of bronze to black was obtained.

The table below shows the relation between electrolytic colouring time and colour depth of the film.

| Time of electrolysis (sec) | 75 | 150 | 220 | 420 |
|---|---|---|---|---|
| Hunter luminocity (L) | 32.0 | 20.6 | 15.4 | 10.9 |

COMPARATIVE EXAMPLE 1

Two aluminium panels (JIS A-1100) anodized in the same manner as in example 1 were electrolytically coloured in a bath having the same composition as in example 1 by commercial AC current (frequency 60 Hz) at a span voltage of 14 V, one for 150 seconds, and the other for 420 seconds.

The colour was measured on the film of the aluminium panels. Hunter luminocity L values were 40.8 and 32.5, respectively, which were far lighter than those of example 1.

COMPARATIVE EXAMPLE 2

An aluminium panel (JIS A-1100) was anodized and subjected to preliminary electrolytic treatment in an electrolytic bath containing the same metal salts as in example 1. Then it was used as a cathode for electrolytic colouring by passing a direct current of 0.2 A/dm$^2$ in the same electrolytic bath. Although 33.1 Hunter luminocity was obtained by electrolysis for 75 seconds, the colour did not darken more than 51.5 even after continuing electrolysis for 150 seconds. Moreover, surface roughening caused by deposition of nicken hydrate was observed on the film.

COMPARATIVE EXAMPLE 3

An aluminium panel (JIS A-1100) was anodized and anodically treated in preliminary electrolysis, in the same manner as in example 1. This panel was then subjected to electrolytic colouring for 90 seconds under the same electrolytic conditions as in example 1, except that the ta/tc ratio was 1.0. After 90 seconds of electrolysis, the increase in voltage required to maintain the necessary current became excessive, so that it was practically impossible to continue.

The colour obtained on the aluminium panel after 90 seconds of electrolysis had a Hunter luminocity of 48.9, which was much lighter than that in example 1.

EXAMPLE 2

An extruded hollow section of JIS A-6063 aluminium (outer dimensions 40 mm×20 mm×250 mm, thickness 2 mm) was anodized in a sulphuric acid bath as in example 1.

The anodized aluminium hollow section was then set in an electrolytic cell, perpendicular to a titanium counter electrode, along the side of the cell, and subjected to preliminary electrolytic treatment at an anodic current density of 0.2 A/dm$^2$ for 40 seconds. The electrolytic bath had the following composition

| | | |
|---|---|---|
| Nickel sulphate | $NiSO_4 . 6H_2O$ | 70 g/l |
| Magnesium sulphate | $MgSO_4 . 7H_2O$ | 50 g/l |
| Boric acid | $H_3BO_4$ | 30 g/l |
| Citric acid | | 5 g/l |
| Water | | Balance |

Next, the aluminium section was used as a cathode, for electrolytic colouring with direct current, having a pulsed voltage superimposed thereon, passing between the aluminium section and a counter electrode under the following conditions:

| | |
|---|---|
| Pulse repetition rate | 600 times/min. |
| ta/tc ratio | 0.10 |
| Cathodic density | 0.2 A/dm$^2$ |
| Time of electrolysis | 150 seconds |
| Bath temperature | 20° C. |

Upon completion of electrolytic colouring, the aluminium section was rinsed in water, then immersed in boiling water for sealing. An aluminium section coloured bronze was obtained.

Results of the measurement of colours on outside and inside surfaces of the aluminium section showed that Hunter lumin city L values were in a range of 25.1±0.8, indicating very uniform colouring with high throwing power.

EXAMPLE 3

A JIS A-1100 aluminium panel was anodized to produce an oxide film coating similar to example 1.

The above treated aluminium panel was then subjected to a preliminary electrolytic treatment in a tin salt electrolyte having the following composition by passing anodic direct current at a density of 0.5 A/dm$^2$ for 20 seconds, with a titanium counter electrode as the cathode.

| | | |
|---|---|---|
| Tin (I) sulphate | $SnSO_4$ | 10 g/l |
| Sulphuric acid | $H_2SO_4$ | 5 g/l |
| Citric acid | | 10 g/l |
| Sulfamic acid | | 10 g/l |
| Ammonium sulphate | $(NH_4)_2SO_4$ | 7 g/l |
| Water | | Balance |

Next, with the aluminium panel connected as a cathode, electrolytic colouring was carried out by passing a direct current superimposed with a pulsed voltage, in the above tin salt electrolytic bath under the following conditions.

| | |
|---|---|
| Pulse repetition rate | 1200 times/min. |
| ta/tc ratio | 0.10 |
| Cathodic current density | 0.4 A/dm$^2$ |
| Time of electrolysis | 120 seconds |
| Bath temperature | 20° C. |

After rinsing with water, the electrolytically coloured aluminium panel was sealed in boiling water. The aluminium panel so produced was black with a bronze overtone.

Hunter luminocity L of the aluminium panel was 11.3 and the colour was very uniform.

What is claimed is:

1. In a method of producing colour-anodized aluminium or aluminium alloy articles comprising the steps of: (a) forming an anodic oxide film on the surface of the article by conventional anodizing treatment, (b) subjecting the anodized article to a non-colouring direct current anodic electrolytic treatment to reinforce the barrier layer of the initial anodic oxide film, and (c) subsequently subjecting the resultant article to cathodic electrolytic colouring in an electrolytic bath containing at least one metallic colouring salt, by passing current between the article as cathode and a counter electrode, the improvement wherein said cathodic electrolytic current is a negative voltage direct current having superimposed thereon pulses of a positive voltage, said positive pulses having a duration substantially less than the interval therebetween and being repeated at a frequency sufficient to produce good coloration of said article film.

2. A method according to claim 1 wherein the electrolyte used for step (b) is the same as the electrolyte used subsequently for colouring step (c).

3. A method according to claim 1 wherein in step (b) the current density is in the range 0.05 to 0.5 A/dm$^2$.

4. A method according to claim 1 wherein step (b) is carried out for 20–60 seconds.

5. A method according to claim 1 wherein during colouring step (c), the negative current density during the cathodic period is in the range 0.05–0.5 A/dm$^2$.

6. A method according to claim 1 wherein the repetition frequency of the superimposed pulses in step (c) is 60–1800/min.

7. A method according to claim 6 wherein the repetition rate is 120–1200/min.

8. A method according to claim 6 wherein the ratio of duration of said positive pulse to the interval therebetween is in the range of 0.005–0.30.

9. A method according to claim 8 wherein said time ratio is in the range 0.01–0.25.

10. A method according to claim 1 wherein the pulses are superimposed on the direct current in discontinuous bursts of multiple pulses.

11. A method according to claim 10 wherein each pulse burst has a duration of 5–20 seconds and is separated from the preceding pulse burst by an interval of 5–20 seconds.

12. A method according to claim 1 wherein said counter electrode has at least its surface formed from one or more of Pt, Rh, Au, or Ti.

13. A method according to claim 1 wherein the colour-anodized aluminium or aluminium alloy article is sealed by contact with steam or hot water or is finished by coating with clear lacquer.

14. A colour-anodized aluminium or aluminium alloy article produced according to claim 1.

* * * * *